United States Patent [19]

High, Jr. et al.

[11] Patent Number: 4,763,702

[45] Date of Patent: Aug. 16, 1988

[54] PORTABLE FEED MATERIAL TRANSFERRING AND BAGGING APPARATUS

[75] Inventors: Samuel E. High, Jr., Lititz; Aquila D. Mast, Lancaster, both of Pa.

[73] Assignee: Feedmobile, Inc., Lititz, Pa.

[21] Appl. No.: 19,457

[22] Filed: Feb. 26, 1987

[51] Int. Cl.[4] ..... B65B 9/00; B65B 25/02

[52] U.S. Cl. ..... 141/114; 141/83; 141/67; 141/231; 141/256

[58] Field of Search ..... 141/10, 67, 68, 114, 141/313-317, 250-284, 231, 232, 233, 83

[56] References Cited

U.S. PATENT DOCUMENTS

| | | | |
|---|---|---|---|
| 104,297 | 6/1870 | Gephart | 141/248 |
| 726,143 | 4/1903 | Courtland | 141/231 |
| 851,791 | 4/1907 | Apple | 141/256 |
| 1,495,886 | 5/1924 | Craite | 141/231 |
| 2,760,748 | 8/1956 | Ahlburg | 219/61 |
| 2,888,045 | 5/1959 | Reaves et al. | 141/69 |
| 3,083,780 | 4/1963 | Swenson | 177/52 |
| 3,406,727 | 10/1968 | Rexus | 141/131 |
| 4,300,600 | 11/1981 | Tetenborg et al. | 141/10 |
| 4,432,186 | 2/1984 | McGregor | 141/114 X |
| 4,484,606 | 11/1984 | Kosters | 141/114 |
| 4,558,724 | 12/1985 | Carlsson | 141/286 |
| 4,567,820 | 2/1986 | Munsell | 141/114 X |
| 4,672,794 | 6/1987 | Good | 141/114 X |

*Primary Examiner*—Henry J. Recla

*Assistant Examiner*—Ernest G. Cusick

*Attorney, Agent, or Firm*—Michael R. Swartz; John R. Flanagan

[57] ABSTRACT

A portable feed material transferring and bagging apparatus includes a transfer conveyor and a bagging unit both mounted on a mobile frame. The transfer conveyor is mounted such that the positions of its opposite inlet and discharge ends can be vertically adjusted to elevations at which the bagging unit would not fit below its inlet end but will fit below its discharge end. The transfer conveyor is operable in a feed material transferring mode of operation to transfer feed material from its inlet to discharge end where it is received in the bagging unit. The bagging unit is mounted such that its position can be vertically adjusted to various elevations to accommodate filling bags of different sizes. The bagging unit is operable in a bag filling mode of operation to fill bags with feed material up to preset weights. A flexible duct couples the discharge end of the conveyor with the bagging unit whereby discharging of feed material from the conveyor into the bagging unit can be accomplished at any combination of respective elevations of the bagging unit and the conveyor inlet and discharge ends within their respective adjustment ranges. An arrangement of electrical and hydraulic components powering the conveyor are controlled directly by a microswitch on the bagging unit for pacing periods of operation of the conveyor in coordination with periods of operation of the bagging unit.

25 Claims, 5 Drawing Sheets

PORTABLE FEED MATERIAL TRANSFERRING AND BAGGING APPARATUS

BACKGROUND OF THE INVENTION

1. Field of the Invention

The present invention generally relates to feed material handling and, more particularly, is concerned with a portable apparatus for transferring feed material from any one of a variety of different storage facility low elevation discharge outlets and filling successive bags or containers with quantitites of the feed material up to preset weights.

2. Description of the Prior Art

The handling, storing, marketing and transporting of a wide variety of materials, such as grains, livestock feed, and fruit and vegetable crops, in bags is a long and widely accepted practice. Although initially bagging of the materials was undoubtedly carried out manually, the mechanized transfer and bagging of materials has been carried out in the prior art for many years. Representative of the prior art are the apparatuses disclosed in Gephart (U.S. Pat. No. 104,297), Apple (U.S. Pat. No. 851,791), Ahlburg (U.S. Pat. No. 2,760,748), Reaves et al (U.S. Pat. No. 2,888,045), Swenson (U.S. Pat. No. 3,083,780), Rexus (U.S. Pat. No. 3,406,727), Kosters (U.S. Pat No. 4,484,606) and Carlsson (U.S. Pat. No. 4,558,724).

While many of the above-cited apparatuses as well as others in the prior art probably operate reasonably well and generally achieve their objectives under the limited range of operating conditions for which they were designed, none appears to be sufficiently versatile to handle present needs. For instance, livestock grain and feed are typically stored in a wide variety of different types of storage facilities which can have discharge outlets at different, but relatively low elevations. As an example, a storage bin can have an outlet as low as eighteen inches above its floor which is too low to accommodate a bagger unit. Also, the discharge outlet of a feed grinder or mixer is generally too low to accommodate the unit.

Consequently, a need remains unfilled in the prior art for an apparatus sufficiently versatile to interface a bagging operation with such wide variety of different types of material storage and processing facilities.

SUMMARY OF THE INVENTION

The present invention provides a portable feed material transferring and bagging apparatus designed to satisfy the aforementioned needs. The portable apparatus of the present invention employs a feed material transfer conveyor and a bagging unit on a mobile frame. The inclination of the conveyor is adjustable relative to the surface supporting the mobile frame to adapt the conveyor for use in transferring feed material from any one of a variety of different types of storage facilities having discharge outlets at different, relatively low elevations. Such low elevations generally refer to those locations below which a typical bagging unit would not fit.

The feed material is transferred by the conveyor of the apparatus to a higher elevation which generally refers to those locations below which a typical bagging unit can fit. There, feed material is discharged into the bagging unit, or as is preferably utilized by the apparatus herein, a weighing and bagging unit. The elevation of the weighing and bagging unit can be adjusted independently of adjustment of the inclination of the conveyor for accommodating the filling of different sizes of bags with different desired preset weights of feed material without affecting the desired inclination of the conveyor.

The apparatus of the present invention also employs a flexible duct which couples the discharge end of the conveyor with the inlet end of the weighing and bagging unit so that discharge of feed material from the conveyor into the unit can be accomplished at any combination of respective inclined and elevated positions of the conveyor and the weighing and bagging unit within their respective adjustment ranges.

The operation of the feed material transferring conveyor is not continuous, but instead is controlled and paced by the feed material weighing and bagging operation. The apparatus of the present invention employs a combination of electrical and hydraulic components to operate the feed material transferring conveyor in coordination with the operation of the weighing and bagging unit. Specifically, the conveyor is powered by a hydraulic motor mounted thereon and connected to a hydraulic pump via a solenoid valve and a variable flow control valve connected in series between the hydraulic motor and the pump. The variable flow control valve can be adjusted to vary and set the speed of the conveyor. An electric motor after being initially turned on constantly runs to continuously drive the hydraulic pump. Operation of the solenoid valve is controlled by operation of the weighing and bagging unit. The solenoid valve is capable of routing flow of hydraulic fluid from the hydraulic pump to either the hydraulic motor for powering operation of the conveyor or a fluid reservoir, bypassing the hydraulic motor, to terminate operation of the conveyor. A microswitch on the weighing and bagging unit actuates the solenoid valve to route fluid to the hydraulic motor at the initiation of a bag filling operation, whereas it actuates the solenoid valve in reverse to route fluid back to the reservoir, bypassing the motor, at completion of the bag filling operation.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DESCRIPTION OF THE PREFERRED EMBODIMENT

In the following description, right hand and left hand references are determined by standing at the feed material inlet end (or rear) of the apparatus and facing toward the feed material discharge end (or front) thereof. Also in the following description, it is to be understood that such terms as "forward", "left", "upwardly", etc., are words of convenience and are not to be construed as limiting terms.

Figure 1:
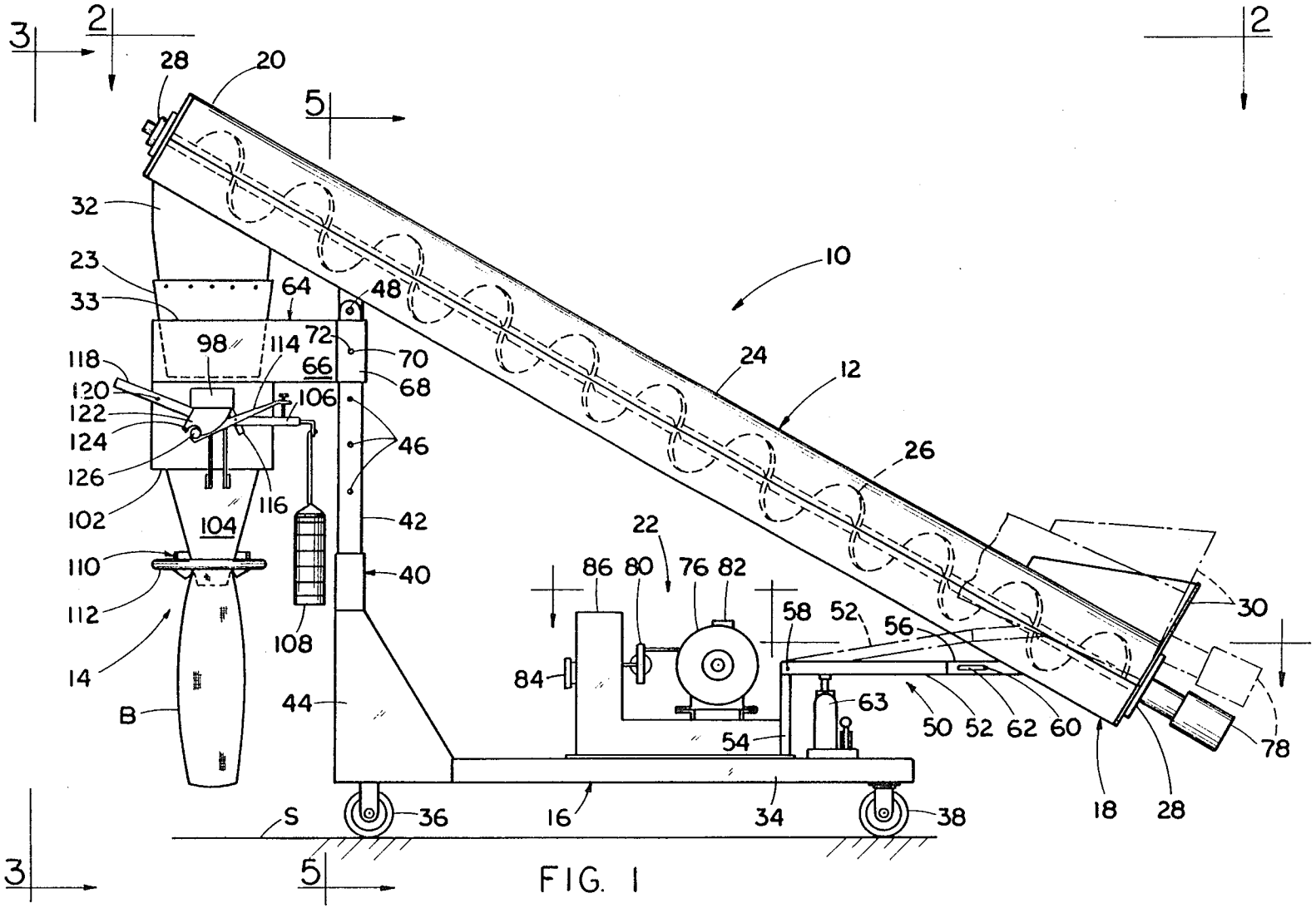
FIG. 1 is a side elevational view of a portable feed material transferring and bagging apparatus which embodies the principles of the present invention.
Figure 2:
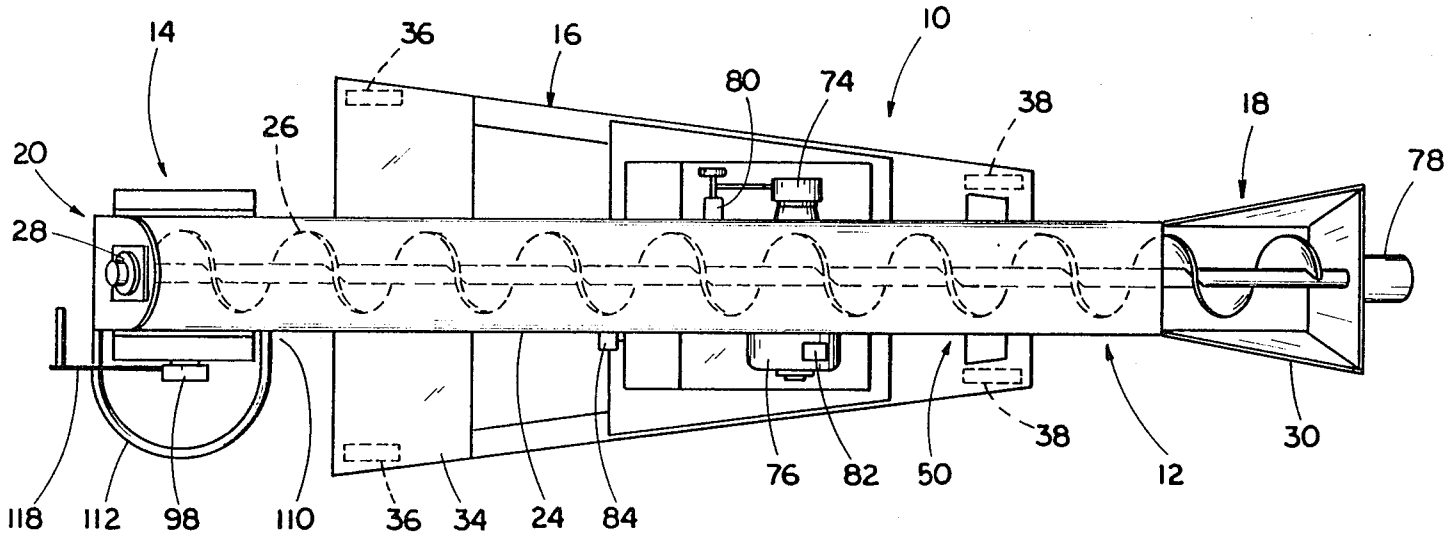
FIG. 2 is a top plan view of the apparatus as seen along line 2—2 of FIG. 1.
Figure 4:
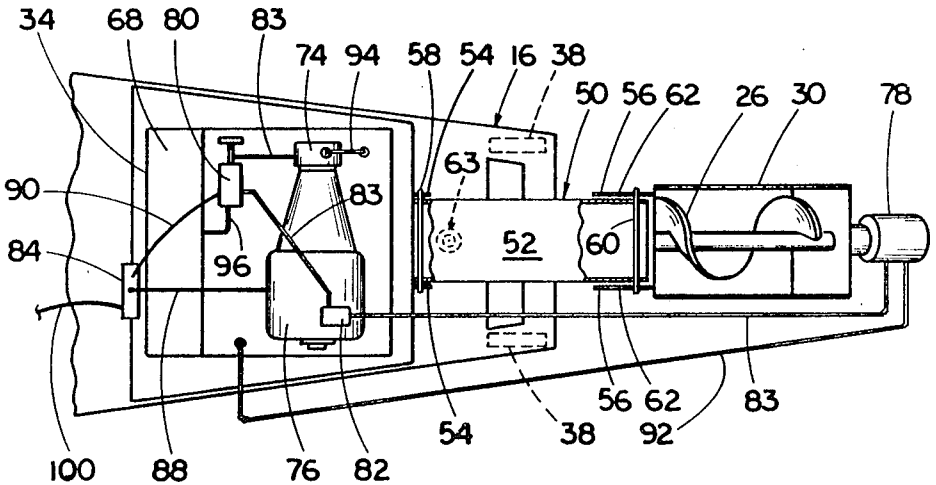
FIG. 4 is a fragmentary top plan view of the apparatus, partly in section, as seen along line 4—4 of FIG. 1, showing the linkage and jack for adjustably mounting the rear end portion of the conveyor to the mobile frame and the arrangement of the electrical and hydraulic components of the power means for operating the conveyor.
Figure 3:
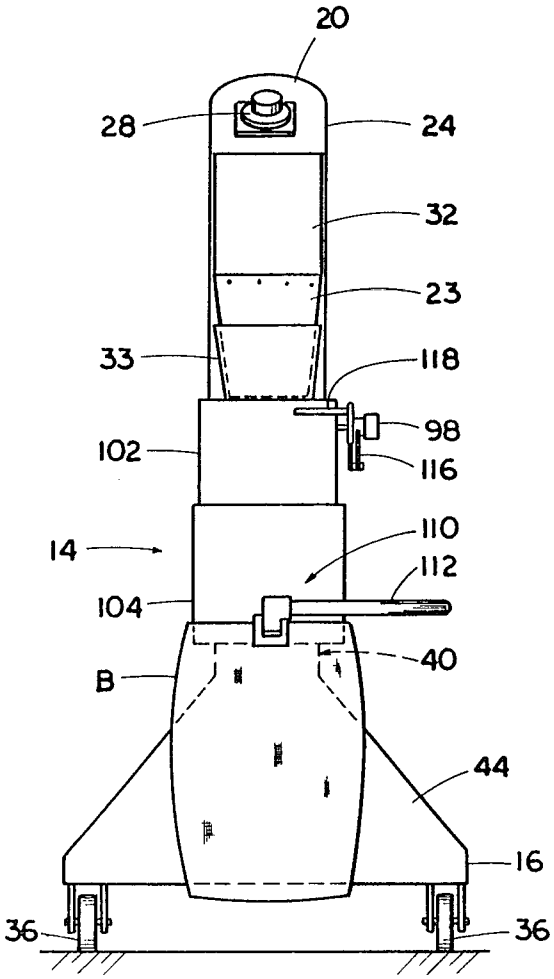
FIG. 3 is a front elevational view of the apparatus as seen along line 3—3 of FIG. 1.

Referring now to the drawings, and particularly to FIGS. 1-3, there is shown a portable feed material transferring and bagging apparatus, being generally designated by the numeral 10, which constitutes the preferred embodiment of the present invention. The left side of the apparatus 10 is depicted in FIG. 1.

The portable apparatus 10 basically includes a transfer conveyor 12 and a weighing and bagging unit 14 (for the sake of brevity, hereinafter referred to as a bagging unit) both mounted on a mobile frame 16. The transfer conveyor 12 is mounted on the frame 16 such that the positions of its opposite inlet and discharge ends 18,20 can be vertically adjusted to respective elevations, as shown in FIG. 1, at which the bagging unit 14 would not fit below the conveyor inlet end 18 but will fit below the conveyor discharge end 20. The transfer conveyor 12 is operable in a feed material transferring mode of operation by power means 22 to transfer feed material, once received at its inlet end 18 such as from the low elevation outlet of a storage facility (not shown), from its inlet to discharge end where it is discharged into the bagging unit 14.

The bagging unit 14 is mounted on the mobile frame 16 such that its position can be vertically adjusted to various elevations to accommodate filling bags of different sizes. The bagging unit 14 is operable in a bag filling mode of operation to fill a bag B with feed material up to a preset weight. The bagging unit 14 can take any suitable form, such as a Model GB-25 bagging scales available from Express Scale Parts, Inc. of Shawnee, Kans. A flexible duct 23 couples the discharge end 20 of the conveyor 12 with the bagging unit 14 whereby discharging of feed material from the conveyor 12 into the bagging unit 14 can be accomplished at any combination of respective elevations of the bagging unit 14 and the conveyor inlet and discharge ends 18,20 within their respective adjustment ranges.

More particularly, the transfer conveyor includes an elongated tubular housing 24 with an auger 26 rotatably mounted at its opposite upper forward and lower rearward ends by bearings 28 to the housing. An open-top flared feed material receiving hopper 30 is connected to and extends above the housing 24 at the inlet end 18 of the conveyor 12. The hopper 30 is also open at its bottom so as to communicate with the housing 24 and auger 26 for delivering feed material thereto by gravity-assisted flow. An open-bottom feed material discharge spout 32 is connected to and extends below the housing 24 at the discharge end 20 of the conveyor 12. The spout 32 is also open at its top so as to communicate with the housing 24 and auger 26 for receiving feed material therefrom by gravity-assisted flow. The hollow flexible duct 23 is attached to and extends downwardly from the spout 32 and is adapted to insert into an inlet end 33 of the bagging unit 14, as depicted in FIG. 3.

Figure 5:
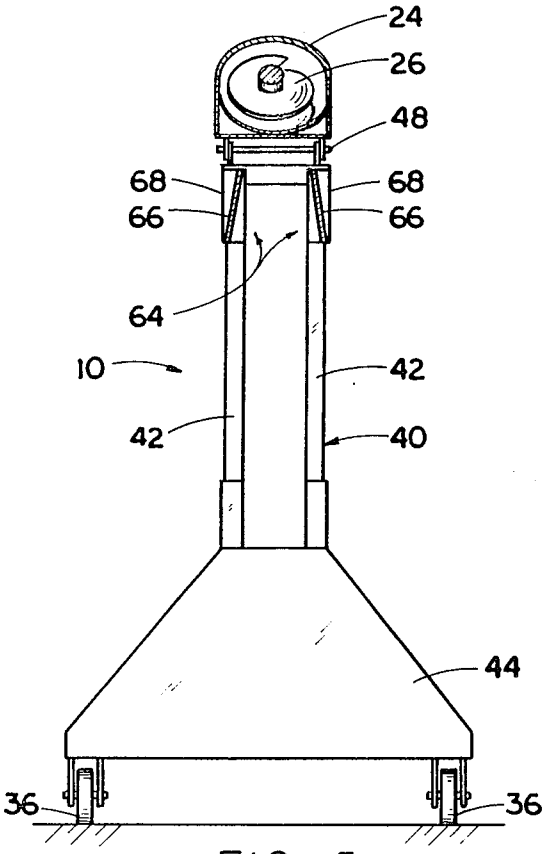
FIG. 5 is a front elevational view of the apparatus, partly in section, as seen along line 5—5 of FIG. 1, showing the pivotal mounting of the front end portion of the conveyor to the upright channel members of the mobile frame of the apparatus.

The mobile frame 16 of the portable apparatus 10 is adapted to stand on a support surface S, such as the ground or floor of a building. The frame 16 includes a base 34 having a generally trapezoidal configuration and supported above the surface S by front and rear pairs of laterally spaced caster wheels 36,38. At the front end of the frame base 34 is rigidly mounted an upright structure 40 in the form of a pair of upstanding channel members 42, as seen in FIG. 5. The channel members 42 are reinforced by generally triangular-shaped brace plates 44 attached between the frame base 34 and the members 42 at the front and sides thereof. The channel members 42 have a plurality of vertically spaced adjustment holes 46 defined therein, the purpose for which will become clear below. At the upper ends of the channels 42, the discharge end 20 of the conveyor 12 is supported on the upright structure 40 by a pivot pin 48 which connects the conveyor housing 24 to the channel members 42. It will be observed that, in such arrangement best shown in FIGS. 1 and 3, the discharge end 20 of the conveyor 12 is thus disposed at an elevation sufficiently above the surface S to accommodate the presence of the bagging unit 14 directly thereunder.

For effecting changes in the respective elevations of the inlet and discharge ends 18,20 of the conveyor 12, an adjustment mechanism 50 is mounted on the rear end of the frame base 34. The adjustment mechanism includes an elongated link 52 pivotally mounted to and extending between a pair of upstanding laterally-spaced braces 54 fixed on the frame base 34 and a pair of short laterally-spaced links 56 fixed on the conveyor housing 24 adjacent its inlet end 18. Pivot pins 58, 60 respectively pivotally couple the front and rear ends of the link 52 to the upper ends of the braces 54 and to the slots 62 formed in the short links 56. The adjustment mechanism 50 also includes an extendable and retractable mechanism 63 mounted on the frame base 34 and engaged with the underside of the link 52. The mechanism 63 which can take any suitable form such as a hydraulic cylinder or a manually-actuated hydraulic jack as seen in FIG. 1, is operable for causing pivoting of the link 52 and thereby pivoting of the conveyor 12 about pivot pin 48 at its discharge end 20.

In such manner, the elevations of the inlet and discharge ends 18,20 of the conveyor 12 are adjusted (changed and set) relative to the frame 16 and surface S within an adjustment range determined by the limits of permitted pivotal travel of the link 52 of the adjustment mechanism 50. However, it is the change in the elevation of the inlet end 18 of the conveyor 12 which is desired in order to set the inlet end at the proper height or elevation for receiving feed material from a low elevation supply source. A change in the elevation of the discharge end 20 naturally results whenever the elevation of the inlet end 18 is changed; however, the arc swept by the discharge end 20 is relatively small compared to that of the inlet end 18 due to the placement of the pivotal mounting location of the conveyor 12 (at pin 48) adjacent its discharge end 20 and remote from its inlet end 18. It will be observed that an additional adjustment could readily be introduced at the discharge end 20 by replacing the pair of channel members 42 with telescoping ones so that the height of the pivot pin 48 above the surface S could be varied.

The bagging unit 14 of the portable apparatus 10 is supported with its inlet end 33 below the discharge end 20 of the transfer conveyor 12 by a transverse structure 64, best seen in FIGS. 1 and 5. The transverse support structure 64 includes a pair of support members 66 connected at their outer ends to the bagging unit 14 and each having a sleeve 68 connected to their inner ends. The sleeves 68 are hollow stub channels being configurated to closely fit with the channel members 42 of the upright structure 40 and slide therealong. The channel-like sleeves 68 each have a hole 70 defined therein being alignable with a pair of adjustment holes 46 in the channel members 42. A suitable fastener 72 is inserted through the aligned holes 46,70 of the channel members 42 and sleeves 68 for attaching the sleeves 68 thereto at a desired elevation therealong. With such an attachment and adjustment arrangement, it can be seen that the transverse structure 64 is adjustable along the upright structure 40, independently of adjustment of the inclination of the conveyor 12, so that the elevation of the bagging unit 14 can be changed and set as desired within its range of adjustment without affecting the elevations of the inlet and discharge ends 18,20 of the conveyor 12. Thus, the elevation of the bagging unit 14 can be adjusted independently of adjustment of the inclination of the conveyor 12 for accommodating the filling of different sizes of bags.

The power means 22 of the portable apparatus 10 is composed of an arrangement of electrical and hydraulic components which power the conveyor 12 in its feed material receiving and transferring mode of operation in a manner controlled directly by operation of the bagging unit 14. In such manner, the periods of operation of the conveyor 12 are paced in coordination with periods of operation of the bagging unit 14.

More particularly, referring to FIGS. 1, 2, 4 and 6, the power means 22 for operating the conveyor 12 includes a hydraulic pump 74 and an electric motor 76 both mounted adjacent one another on the frame base 34. When turned on, the electric motor 76 constantly runs and continuously drives the hydraulic pump 74. Thus, there is no frequent starting and stopping of the electric motor 76 to interrupt operation of the conveyor 12 at the completion of each bag filling operation which could burn out the motor 76. The power means 22 also includes a hydraulic motor 78 mounted at the inlet end of the conveyor 12 to its housing 24 and coupled to rotatably drive the auger 26. A conveyor actuating valve 80, such as an electric solenoid valve, and a variable flow control valve 82 are interposed in series in fluid supply line 83 extending from the hydraulic pump 74 to the hydraulic motor 78. The variable flow control valve 82 is adjustable for varying and setting the rate of flow of hydraulic fluid to the hydraulic motor 78 and thereby the rotational speed of the conveyor auger 26. The electric motor 76 and the conveyor actuating valve 80 are both electrically connected via electrical leads 88,90 to an electrical power box 84 mounted to the front side of an L-shaped hydraulic fluid reservoir 86. A fluid return line 92 from the hydraulic motor 78 and a fluid supply line 94 to the hydraulic pump 74 are connected to the reservoir 86. The valve 80 is also connected via line 96 to the reservoir 86.

The actuating valve 80 is actuatable between first and second positions for correspondingly actuating and deactuating operation of the hydraulic motor 78 and thus the conveyor 12. When the actuating valve 80 is in its first position, it routes flow of hydraulic fluid from the hydraulic pump 74 to the hydraulic motor 78 to power operation of the conveyor 12. On the other hand, when the valve 80 is in its second position, it routes flow of hydraulic fluid from the hydraulic pump 74 directly back to the fluid reservoir 86, bypassing the hydraulic motor 78, which terminates operation of the conveyor 12.

Figure 6:
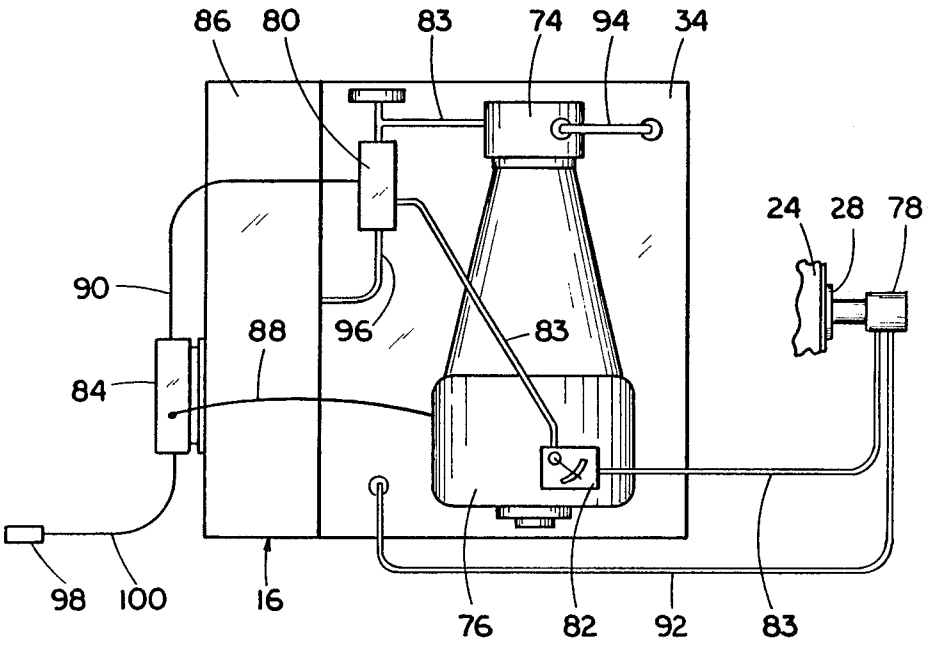
FIG. 6 is an enlarged fragmentary top plan view of the arrangement of the electrical and hydraulic components of the power means for operating the conveyor of the apparatus.

Means in the form of a microswitch 98 on the bagging unit 14, as seen in FIGS. 1–3 and 6–8, is adapted to switch between first and second conditions in response to initiation and completion of the bag filling operation performed by the bagging unit. As seen in FIG. 6, the microswitch 98 is electrically connected via lead 100 and power box 84 to the conveyor actuating valve 80. The actuating valve 80 is actuated between its first and second positions in response to switching of the microswitch 98 between its corresponding first and second conditions.

With reference to FIGS. 1–3, 7 and 8, the components of the bagging unit 14 can be seen. The bagging unit 14 has an upper hollow housing 102 which is rigidly attached to and supported by the outer end of the transverse structure 64. The unit 14 also has a lower hollow housing 104 which is suspended from the inner ends of a pair of weight balance beams 106 (only one being shown) which are pivotally attached to the opposite sides of the upper housing 102 near their inner ends and support a counterweight 108 at their outer ends. A bag B is clamped to the bottom of the lower housing 104 by a clamping mechanism 110 having a manually-operated handle 112 to actuate the bag clamping mechanism.

The bagging unit 14 also includes a guage arm 114 mounted at the side of the upper housing 102 at the same pivot as the balance beams 106 but pivotable independent of them. A microswitch-engaging finger 116 is attached to and pivots with the gauge arm 114. An actuating lever 118 is also pivotally mounted to the housing 102 at 120 and has a cam element 122 on its inner end in which is defined a notch 124. When the actuating lever 118 is rotated counterclockwise from its FIG. 8 to FIG. 7 position, a roller 126 on the inner end of the gauge arm 114 will seat in the notch 124 due to a spring (not shown) which biases the arm 114 in a clockwise direction. The bias on the arm 114 also normally holds the microswitch-engaging finger 116 in contact with the microswitch 98 to maintain it in its aforementioned first condition which it assumes at initiation of a bagging operation and maintains until completion of the same.

Figure 8:
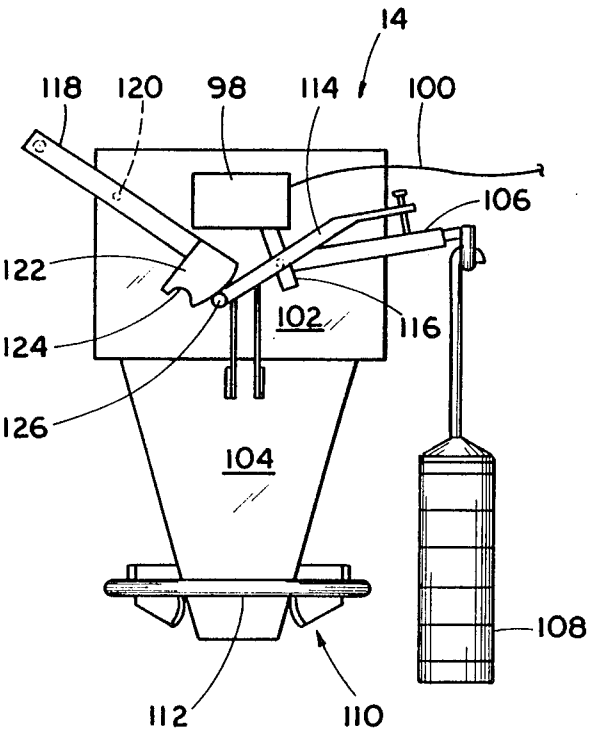
FIG. 8 is a view similar to that of FIG. 7, but showing the relative positions of the basic components of the weighing and bagging unit at the completion of the bag filling operation.
Figure 7:
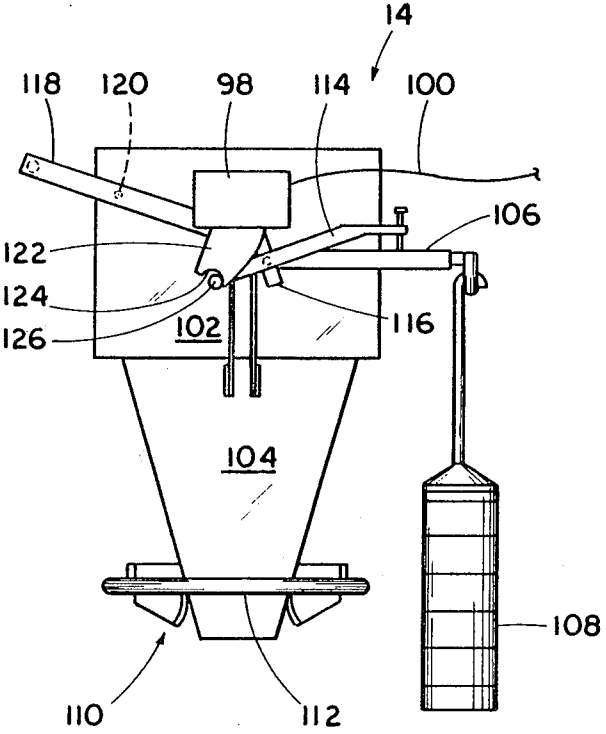
FIG. 7 is an enlarged fragmentary side elevational view of the apparatus of FIG. 1, showing the relative positions of the basic components of the weighing and bagging unit at the start of a bag filling operation.

When the actuating lever 118 is rotated to its FIG. 8 position after completing of a filling operation, its cam element 122 engages the roller 126 and holds the gauge arm 114 against its bias such that the finger 116 is out of contact with the microswitch 98, resulting in the microswitch being in its second condition. As described above, in its second condition, the microswitch 98 actuates the conveyor actuating valve 80 to its second position which terminates operation of the conveyor 12.

The bagging unit 14 further includes a gate or trap door (not shown) pivotally mounted within the upper housing 102 and operable between a first opened position which permits flow of feed material through the housing and a second closed position which blocks the flow of feed material therethrough. The pivotal gate is operably interconnected by linkage (not shown) to the balance beams 106 so as to operate simultaneously with the operation of the microswitch 98. The primary purpose of the pivotal gate is to prevent or ensure that no feed material passes down through the housing 102 and out the bottom of the lower housing 104 once the operation of the conveyor 12 is stopped and to allow passage of feed material therethrough when the conveyor is operating. The gate is a component of the specific bagging unit perse and is not a part of the present invention.

When a bag B is installed on the bottom of the lower housing 104 and held there by the clamping mechanism 110, the actuating lever 118 is then pivoted counterclockwise to initiate filling of the bag B causing the finger 116 to contact and return the microswitch 98 to its first condition which commences operation of the conveyor 12. As the feed material is discharged from the conveyor 12 into the unit 14 and fills the bag, the bag increases in weight toward the preset limit. As the bag increases in weight, the counterweight 108 moves upward until it contacts and rotates the gauge arm 114 counterclockwise as the preset weight limit is reached. At that moment the finger 116 rotating with the gauge arm 114 breaks contact with the microswitch 98 allowing it to assume its second condition which actuates the conveyor actuating valve 80 to its second position and interrupts operation of the conveyor 12. The counterclockwise rotation of the gauge arm 114 allows the actuating lever 118, due to the weight of its cam element 112, to rotate clockwise and wedge against the roller 126. The filled bag B is then removed and replaced with an empty one. Then the filling operation is again initiated by pivoting the actuating lever 118 down or counterclockwise until the roller 126 is seated in the notch 124.

It is thought that the present invention and many of its attendant advantages will be understood from the foregoing description and it will be apparent that various changes may be made in the from, construction and arrangement of the parts thereof without departing from the spirit and scope of the invention or sacrificing all of its material advantages, the forms hereinbefore described being merely a perferred or exemplary embodiment thereof.

We claim:

1. In a portable feed material transferring and bagging apparatus, the combination comprising:

(a) a mobile frame adapted to stand on a support surface;

(b) an elongated feed material transfer conveyor having opposite feed material inlet and discharge ends and being operable for receiving feed material at its inlet end and transferring feed material to, and discharging feed material at, its discharge end;

(c) a feed material bagging unit having opposite inlet and discharge ends and being operable to receive at its inlet end feed material being discharged from said conveyor at said discharge end thereof and to fill bags therewith;

(d) an upright structure mounted on said frame and pivotally supporting said conveyor adjacent its discharge end and thereby disposing said conveyor discharge end at an elevation within a range thereof above the surface supporting said mobile frame so as to adapt said discharge end of said conveyor to discharge feed material at locations below which said bagging unit can fit;

(e) an adjustment mechanism on said frame connected to said conveyor adjacent its inlet end and being operable for changing and setting the elevation of said inlet end of said conveyor within a range thereof above the surface supporting said mobile frame so as to adapt said inlet end of said conveyor to receive feed material at locations below which said bagging unit would not fit, said changing of the elevation of said inlet end of said conveyor by said adjustment mechanism also causing pivoting of said discharge end of said conveyor relative to said upright structure and thereby changing of the elevation of said conveyor discharge end; and (f) a transverse structure mounted on said upright structure and supporting said bagging unit with its inlet end below said discharge end of said conveyor, said transverse structure being adjustable along said upright structure, independently of operation of said adjustment mechanism, for changing and setting the elevation of said bagging unit within a range thereof without affecting the changing and setting of said elevations of said inlet and discharge ends of said conveyor by operation of said adjustment mechanism, whereby the elevation of said bagging unit can be adjusted independently of adjustment of the elevations of said conveyor inlet and discharge ends for accommodating the filling of different sizes of bags;

(g) said upright structure including at least one upstanding channel member fixed on said frame, said channel member pivotally supporting said conveyor adjacent its discharge end and having a plurality of vertically spaced adjustment holes defined therein;

(h) said transverse structure including a support member connected at one end to said bagging unit and having a sleeve connected to its other end, said sleeve being slidable along said channel member and having at least one hole alignable with at least one of said adjustment holes in said channel, said transverse structure also including fastening means insertable through said aligned holes of said sleeve and channel for attaching said sleeve thereto at a desired elevation therealong.

2. The apparatus as recited in claim 1, further comprising:

a flexible duct coupling said discharge end of said conveyor with said inlet end of said bagging unit so that discharging of feed material from said conveyor into said bagging unit can be accomplished at any combination of respective elevations of said bagging unit and said conveyor inlet and discharge ends within their respective adjustment ranges.

3. The apparatus as recited in claim 1, wherein said feed material transfer conveyor includes:

a tubular housing;

an auger rotatably mounted at its opposite ends to said housing;

a feed material receiving hopper connected to and extending above said housing and communicating with said auger at said inlet end of said conveyor; and a feed material discharge spout connected to and extending below said housing and communicating with said auger at said discharge end of said conveyor.

4. The apparatus as recited in claim 1, wherein said bagging unit is a feed material weighing and bagging unit.

5. The apparatus as recited in claim 1, wherein said adjustment mechanism includes:

a link pivotally mounted to and extending between said frame and said conveyor adjacent its inlet end; and an extendable and retractable mechanism mounted on one of said frame and said conveyor and engaged with said link, said mechanism being operable upon extension and retraction for causing pivoting of said link and thereby pivoting of said conveyor about its discharge end and adjustment of the elevations of said inlet and discharge ends of said conveyor with respect to said frame.

6. The apparatus as recited in claim 5, wherein said extendable and retractable mechanism is a hydraulic jack.

7. In a portable feed material transferring and bagging apparatus, the combination comprising:

(a) a mobile frame;

(b) an elongated feed material transfer conveyor supported on said mobile frame and having opposite feed material inlet and discharge ends. said conveyor being operable in a feed material transferring mode of operation to receive feed material at its inlet end and transfer feed material to, and discharge feed material at, its discharge end;

(c) a feed material bagging unit supported on said mobile frame and being operable in a bag filling mode of operation to receive feed material being discharged from said conveyor at said discharge end thereof and to fill bags therewith;

(d) means operable for powering said conveyor in said feed material receiving and transferring mode of operation; and (e) switch means on said bagging unit adapted to switch between first and second conditions in response to initiation and completion of said bag filling mode of operation;

(f) said conveyor powering means being controlled directly by said bagging unit switch means for providing periods of operation of said conveyor in coordination with periods of operation of said bagging unit;

(g) said conveyor powering means including (i) a hydraulic pump mounted on said mobile frame, (ii) a hydraulic motor mounted on said conveyor for powering the same, (iii) a conveyor actuating valve interconnecting said pump with said hydraulic motor and being actuatable between first and second positions for correspondingly actuating and deactuating operation of said conveyor, and (iv) an electric motor mounted on said mobile frame which constantly runs after being turned on to continuously drive said hydraulic pump.

8. The apparatus as recited in claim 7, wherein said conveyor actuating valve is a solenoid valve.

9. The apparatus as recited in claim 7, further comprising:

a reservoir containing hydraulic fluid and being connected to said hydraulic motor, said hydraulic pump and said conveyor actuating valve.

10. The apparatus as recited in claim 9, wherein said conveyor actuating valve when in its first position routes flow of hydraulic fluid from said hydraulic pump to said hydraulic motor to power operation of the conveyor and when in its second position routes flow of hydraulic fluid from said hydraulic pump back to said fluid reservoir, bypassing said hydraulic motor, to terminate operation of said conveyor.

11. The apparatus as recited in claim 1, wherein said switch means is a microswitch on said bagging unit being interconnected to said conveyor actuating valve and which actuates said conveyor actuating valve between its first and second positions in response to switching of said microswitch between its corresponding first and second conditions.

12. The apparatus as recited in claim 7, further comprising:

a variable flow control valve connected between said hydraulic motor and said conveyor actuating valve and being adjustable for varying and setting the flow of hydraulic fluid to said hydraulic motor and thereby the speed of said conveyor.

13. The apparatus as recited in claim 7, wherein feed material transfer conveyor includes:

a tubular housing;

an auger rotatably mounted at its opposite ends to said housing;

a feed material receiving hopper connected to and extending above said housing and communicating with said auger at said inlet end of said conveyor; and a feed material discharge spout connected to and extending below said housing and communicating with said auger at said discharge end of said conveyor.

14. The apparatus as recited in claim 7, wherein said bagging unit is a feed material weighing and bagging unit.

15. In a portable feed material transferring and bagging apparatus, the combination comprising:

(a) a mobile frame adapted to stand on a support surface;

(b) an elongated feed material transfer conveyor having opposite feed material inlet and discharge ends and being operable in a feed material transferring mode of operation to receive feed material at its inlet end and transfer feed material to, and discharge feed material at, its discharge end;

(c) a feed material bagging unit having opposite inlet and discharge ends and being operable in a bag filling mode of operation to receive at its inlet end feed material being discharged from said conveyor at said discharge end thereof and to fill bags therewith;

(d) an upright structure mounted on said frame and pivotally supporting said conveyor adjacent its discharge end and thereby disposing said conveyor discharge end at an elevation within a range thereof above the surface supporting said mobile frame so as to adapt said discharge end of said conveyor to discharge feed material at locations below which said bagging unit can fit;

(e) an adjustment mechanism on said frame connected to said conveyor adjacent its inlet end and being operable for changing and setting the elevation of said inlet end of said conveyor within a range thereof above the surface supporting said mobile frame so as to adapt said inlet end of said conveyor to receive feed material at locations below which said bagging unit would not fit, said changing of the elevation of said inlet end of said conveyor by said adjustment mechanism also causing pivoting of said discharge end of said conveyor relative to said upright structure and thereby changing of the elevation of said conveyor discharge end;

(f) a transverse structure mounted on said upright structure and supporting said bagging unit with its inlet end below said discharge end of said conveyor, said transverse structure being adjustable along said upright structure, independently of operation of said adjustment mechanism, for changing and setting the elevation of said bagging unit within a range thereof without affecting the changing and setting of aid elevations of said inlet and discharge ends of said conveyor by operation of said adjustment mechanism, whereby the elevation of said bagging unit can be adjusted independently of adjustment of the elevations of said conveyor inlet and discharge ends for accommodating the filling of different sizes of bags;

(g) a flexible duct coupling said discharge end of said conveyor with said inlet end of said bagging unit so that discharging of feed material from said conveyor into said bagging unit can be accomplished at any combination of respective elevations of said bagging unit and said conveyor inlet and discharge ends within their respective adjustment ranges;

(h) means operable for powering said conveyor in said feed material receiving and transferring mode of operation; and (i) switch means on said bagging unit adapted to switch between first and second conditions in response to initiation and completion of said bag filling mode of operation;

(j) said conveyor powering means being controlled directly by said bagging unit switch means for providing periods of operation of said conveyor in coordination with periods of operation of said bagging unit;

(k) said conveyor powering means including (i) a hydraulic pump mounted on said mobile frame, (ii) a hydraulic motor mounted on said conveyor for powering the same, (iii) a conveyor actuating valve interconnecting said pump with said hydraulic motor and being actuatable between first and second positions for correspondingly actuating and deactuating operation of said conveyor, and (iv) an electric motor mounted on said mobile frame which constantly runs after being turned on to continuously drive said hydraulic pump.

16. The apparatus as recited in claim 15, wherein said conveyor actuating valve is a solenoid valve.

17. The apparatus as recited in claim 15, further comprising:

a reservoir containing hydraulic fluid and being connected to said hydraulic motor, said hydraulic pump and said conveyor actuating valve.

18. The apparatus as recited in claim 17, wherein said conveyor actuating valve when in its first position routes flow of hydraulic fluid from said hydraulic pump to said hydraulic motor to power operation of the conveyor and when in its second position routes flow of hydraulic fluid from said hydraulic pump back to said fluid reservoir, bypassing said hydraulic motor, to terminate operation of said conveyor.

19. The apparatus as recited in claim 15, wherein said switch means is a microswitch on said bagging unit being interconnected to said conveyor actuating valve and which actuates said conveyor actuating valve between its first and second positions in response to switching of said microswitch between its corresponding first and second conditions.

20. The apparatus as recited in claim 15, further comprising:

a variable flow control valve connected between said hydraulic motor and said conveyor actuating valve and being adjustable for varying and setting the flow of hydraulic fluid to said hydraulic motor and thereby the speed of said conveyor.

21. The apparatus as recited in claim 15, wherein said feed material transfer conveyor includes:

a tubular housing;

an auger rotatably mounted at its opposite ends to said housing;

a feed material receiving hopper connected to and extending above said housing and communicating with said auger at said inlet end of said conveyor; and a feed material discharge spout connected to and extending below said housing and communicating with said auger at said discharge end of said conveyor, said discharge spout mounting said flexible duct.

22. The apparatus as recited in claim 15, wherein:

said upright structure includes at least one upstanding channel member fixed on said frame and having a plurality of vertically spaced adjustment holes defined therein; and said transverse structure includes a support member connected at one end to said bagging unit and having a sleeve connected to its other end, said sleeve being slidable along said channel member and having at least one hole alignable with at least one of said adjustment holes in said channel member, said transverse structure also including fastening means insertable through said aligned holes of said sleeve and channel for attaching said sleeve thereto at a desired elevation therealong.

23. The apparatus as recited in claim 15, wherein said bagging unit is a feed material weighing and bagging unit.

24. The apparatus as recited in claim 15, wherein said adjustment mechanism includes:

a link pivotally mounted to and extending between said frame and said conveyor adjacent its inlet end; and an extendable and retractable mechanism mounted on one of said frame and said conveyor and engaged with said link, said mechanism being operable upon extension and retraction for causing pivoting of said link and thereby pivoting of said conveyor about its discharge end and adjustment of the elevations of said inlet and discharge ends of said conveyor with respect to said frame.

25. In a portable feed material transferring and bagging apparatus, the combination comprising:

(a) a mobile frame;

(b) an elongated feed material transfer conveyor supported on said mobile frame and having opposite feed material inlet and discharge ends, said conveyor being operable in a feed material transferring mode of operation to receive feed material at its inlet end and transfer feed materiala to, and discharge feed material at, its discharge end;

(c) a feed material bagging unit supported on said mobile frame and being operable in a bag filling mode of operation to receive feed material being discharged from said conveyor at said discharge end thereof and to fill bags therewith;

(d) an upright structure mounted on said frame and pivotally supporting said conveyor adjacent its discharge end and thereby disposing said conveyor discharge end at an elevation within a range thereof above a surface supporting said mobile frame so as to adapt said discharge end of said conveyor to discharge feed material at locations below which said bagging unit can fit;

(e) an adjustment mechanism on said frame connected to said conveyor adjacent its inlet end and being operable for changing and setting the elevation of said inlet end of said conveyor within a range thereof the surface supporting said mobile frame so as to adapt said inlet end of said conveyor to receive feed material at locations below which said bagging unit would not fit, said changing of the elevation of said inlet end of said conveyor by said adjustment mechanism also causing pivoting of said discharge end of said conveyor relative to said upright structure and thereby changing of the elevation of said conveyor discharge end;

(f) a transverse structure mounted on said upright structure and supporting said bagging unit with its inlet end below said discharge end of said conveyor, said transverse structure being adjustable along said upright structure, independently of operation of said adjustment mechanism, for changing and setting the elevation of said bagging unit within a range thereof without affecting the changing and setting of said elevations of said inlet and discharge ends of said conveyor by operation of said adjustment mechanism, whereby the elevation of said bagging unit can be adjusted independently of adjustment of the elevations of said conveyor inlet and discharge ends for accommodating the filling of different sizes of bags;

(g) means operable for powering said conveyor in said feed material receiving and transferring mode of operation; and (h) switch means on said bagging unit adapted to switch between first and second conditions in response to initiation and completion of said bag filling mode of operation;

(i) said conveyor powering means being controlled directly by said bagging unit switch means for providing periods of operation of said conveyor in coordination with periods of operation of said bagging unit.

* * * * *